US006465399B2

(12) United States Patent
Koishikawa et al.

(10) Patent No.: US 6,465,399 B2
(45) Date of Patent: Oct. 15, 2002

(54) LUBRICANT COMPOSITION

(75) Inventors: Naomi Koishikawa; Yukio Tatsumi, both of Tokyo (JP)

(73) Assignee: Asahi Denka Koygo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/771,881

(22) Filed: Jan. 30, 2001

(65) Prior Publication Data

US 2001/0012821 A1 Aug. 9, 2001

(30) Foreign Application Priority Data

Jan. 31, 2000 (JP) ..... 12-022664

(51) Int. Cl.[7] ..... C10M 141/02
(52) U.S. Cl. ..... 508/416; 508/518; 508/579
(58) Field of Search ..... 508/416, 518, 508/579

(56) References Cited

U.S. PATENT DOCUMENTS 3,917,537 A * 11/1975 Elsdon ..... 508/579
4,265,774 A * 5/1981 Langdon ..... 508/579
4,491,526 A * 1/1985 Deck ..... 508/579
5,380,508 A * 1/1995 Inoue ..... 508/186
5,641,729 A * 6/1997 Leendersten ..... 508/111
5,744,053 A * 4/1998 Kaimai ..... 508/579

FOREIGN PATENT DOCUMENTS

JP 11315295 A * 11/1999

OTHER PUBLICATIONS

Abstract, "common Lubricating Oil Composition", JP 59025890, Miyazaki Mamoru, et al., Feb. 9, 1984.

* cited by examiner

*Primary Examiner*—Jacqueline V. Howard
(74) *Attorney, Agent, or Firm*—Sughrue Mion, PLLC

(57) ABSTRACT

The present invention is a lubricant composition, composed of a lubricant base oil containing: a (poly)glyceryl ether represented by the following general formula (1)

(1)

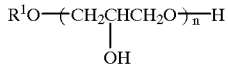

(wherein $R^1$ represents a hydrocarbon group and n represents a numeral being 1 or more.), as a (A) component; and an alkaline-earth metal salt of an organic acid as a (B) component. Furthermore, it is preferable to contain an antioxidant as a (C) component.

As an alkaline-earth metal salt of an organic acid, sulfonate, phenate, or salicylate are preferable, and neutral, basic or overbased calcium salicylate or calcium sulfonate are particularly preferable.

10 Claims, No Drawings

LUBRICANT COMPOSITION

BACKGROUND OF THE INVENTION

1. Field of the Invention

The present invention relates to a lubricant composition, and specifically, it relates to a lubricant composition useful as an automatic transmission fluid, a continuously variable transmission fluid, etc.

2. Description of the Related Art

In recent years, accompanying actions for preventing global warming, there has been a growing trend to decrease an emission of carbon dioxide on a worldwide scale. Accordingly, it is also required to further improve fuel efficiency of automobiles. As a way of improving fuel efficiency, there is an improvement of a powertrain transferring a driving force from an engine to wheels, that is, an improvement of a transmission.

Hitherto, among automatic transmissions (AT) for automobiles dominating transmissions, a type combining a torque converter, a wet clutch, a planetary gear, etc., has been the mainstream. In recent years, a slip control AT being a further advanced AT has been developed. This aims to decrease a power loss in a torque converter by slipping a lockup clutch in a low speed region in which fluctuations in rotation of an engine are large.

In the slip control AT, since a term of continuous slip of the lockup clutch is extremely long compared to conventional ATs, an occurrence of a shudder causes a problem. The shudder means abnormal vibrations and shocks occurred in a slip of a clutch disk when the wet clutch is engaged. Since the shudder not only causes drivers uncomfortable, but also hinders a safe drive in some cases, it is strongly required to prevent such shudders from occurring. Therefore, a performance of preventing these shudders from occurring is required of lubricating oils such as an automatic transmission fluid (ATF) and a continuously variable transmission fluid (CVTF) used for an AT and a continuously variable transmission (CVT).

It is theoretically known that a lubricating oil having a property exhibiting increases in friction coefficient with increasing slip velocity are useful to prevent shudders from occurring. As lubricating oils having such a performance, lubricating oil compositions containing dithiocarbamate compounds and aliphatic acid amine condensates are disclosed in, for example, Japanese Unexamined Patent Application Publication No.11-50077. Techniques disclosed in these prior arts are not, however, satisfied as a lubricating oil having a specific property exhibiting increases in friction coefficient with increasing slip velocity.

Accordingly, the inventors of the present invention earnestly researched and have developed a lubricant composition having a specific property exhibiting increases in friction coefficient with increasing slip velocity by using a (poly)glyceryl ether and an alkaline-earth metal salt of an organic acid together.

SUMMARY OF THE INVENTION

That is, the present invention is a lubricant composition, comprising a lubricant base oil containing: a (poly)glyceryl ether represented by the following general formula (1)

$$R^1O-(CH_2\underset{\underset{OH}{|}}{C}HCH_2O)_n-H \quad (1)$$

(wherein $R^1$ represents a hydrocarbon group and n represents a numeral being 1 or more.) as a (A) component; and an alkaline-earth metal salt of an organic acid as a (B) component.

DETAILED DESCRIPTION OF THE INVENTION

A (A) component of a lubricant composition according to the present invention is a (poly)glyceryl ether represented by the aforementioned general formula (1). In the general formula (1), $R^1$ represents a hydrocarbon group. As the hydrocarbon group, for example, an alkyl group, an alkenyl group, an aryl group, a cycloalkyl group, and a cycloalkenyl group are listed.

As the alkyl group, for example, methyl, ethyl, propyl, isopropyl, butyl, isobutyl, secondary butyl, tertiary butyl, pentyl, isopentyl, secondary pentyl, neopentyl, tertiary pentyl, hexyl, secondary hexyl, heptyl, secondary heptyl, octyl, 2-ethylhexyl, secondary octyl, nonyl, secondary nonyl, isononyl, decyl, secondary decyl, isodecyl, undecyl, secondary undecyl, dodecyl, secondary dodecyl, tridecyl, isotridecyl, secondary tridecyl, tetradecyl, secondary tetradecyl, hexadecyl, secondary hexadecyl, stearyl, isostearyl, icosyl, docosyl, tetracosyl, triaconsyl, 2-propylheptyl, 2-butyloctyl, 2-pentylnonyl, 2-butyldecyl, 2-hexyloctyl, 2-hexyldecyl, 2-octyldecyl, 2-heptylundecyl, 2-hexyldodecyl, 2-octyldodecyl, 2-nonyltridecyl, 2-decyltetradecyl, 2-undecylpentadecyl, 2-dodecylhexadecyl, 2-tridecylheptadecyl, 2-tetradecyloctadecyl, 2-hexadecyloctadecyl, 2-pentadecylnonadecyl, 2-hexadecyleicosyl, and monomethyl branch-isostearyl, are listed.

As the alkenyl group, for example, vinyl, allyl, propenyl, butenyl, isobutenyl, pentenyl, isopentenyl, hexenyl, heptenyl, octenyl, nonenyl, decenyl, undecenyl, dodecenyl, tetradecenyl, and oleyl, are listed.

As the aryl group, for example, phenyl, toluyl, xylyl, cumenyl, mesityl, benzyl, phenethyl, styryl, cinnamyl, benzhydryl, trityl, ethylphenyl, propylphenyl, butylphenyl, pentylphenyl, hexylphenyl, heptylphenyl, octylphenyl, nonylphenyl, decylphenyl, undecylphenyl, dodecylphenyl, phenylphenyl, benzylphenyl, styrenated phenyl, p-cumylphenyl, dinonylphenyl, didodecylphenyl, α-naphthyl, and β-naphthyl group, are listed.

As the cycloalkyl group and the cycloalkenyl group, for example, cyclopentyl, cyclohexyl, cycloheptyl, methylcyclopentyl, methylcyclohexyl, methylcycloheptyl, cyclopentenyl, cyclohexenyl, cycloheptenyl, methylcyclohexenyl, and methylcycloheptenyl group, are listed.

As $R^1$, an alkyl group or an alkenyl group are preferable, an alkyl group or an alkenyl group having a carbon number of 4 to 30 are more preferable, and an alkyl group or an alkenyl group having a carbon number of 8 to 24 are further preferable. In the general formula (1), n is a coefficient representing a degree of polymerization of glycerin, and is a numeral being 1 or more, preferably, is a numeral being 1 to 5, and more preferably, is a numeral 1.2 to 4. In the case in which n is a numeral being 1 or more, n indicates an average value. That is, n indicates an average value of a mixture of a glyceryl ether, a diglyceryl ether, a triglyceryl ether, a tetraglyceryl ether, and so forth.

A preferable blending amount of the (A) component is 0.1 to 10% by weight relative to an entirety of the lubricant composition, and more preferably, is 0.2 to 5% by weight.

A (B) component of the lubricant composition according to the present invention is an alkaline-earth metal salt of an organic acid. As an alkaline-earth metal in the alkaline-earth metal salt of an organic acid, for example, magnesium, calcium, and barium are listed. As an organic acid, sulfonic acid, phenol, salicylic acid, etc., are preferable. Specifically, additives for lubricating oils used as additives for engine oils (detergent) described below are preferable.

As the alkaline-earth metal salt of sulfonic acid, for example, besides a (mono or di)alkylnaphthalene sulfonic acid alkaline-earth metal salt and a petroleum sulfonic acid alkaline-earth metal salt, a substituted benzene sulfonic acid alkaline-earth metal salt represented by the following general formula (B-1)

(B-1)

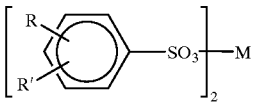

(R and R' represent chain hydrocarbon groups having a carbon number of about 10 to 30, and M represents an alkaline-earth metal atom.) is listed.

As the alkaline-earth metal salt of phenol, for example, the one represented by the following general formula (B-2)

(B-2)

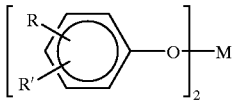

(R and R' represent chain hydrocarbon groups having a carbon number of about 10 to 30, and M represents an alkaline-earth metal atom.), by the following general formula (B-3)

(B-3)

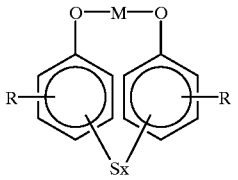

(R and R' represent chain hydrocarbon groups having a carbon number of about 3 to 20, M represents an alkaline-earth metal atom, and x represents a numeral being about 1 to 5.), or by the following general formula (B-4)

(B-4)

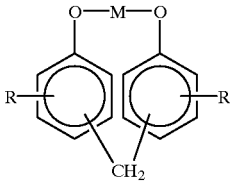

(R represents a chain hydrocarbon group having a carbon number of about 3 to 20, and M represents an alkaline-earth metal atom.), are listed.

As the alkaline-earth metal salt of salicylic acid, for example, the one represented by the following general formula (B-5)

(B-5)

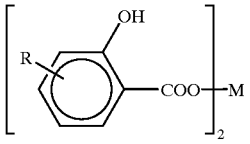

(R represents a chain hydrocarbon group having a carbon number of about 3 to 20, and M represents an alkaline-earth metal atom.), by the following general formula (B-6)

(B-6)

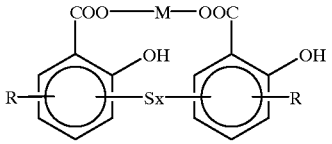

(R represents a chain hydrocarbon group having a carbon number of about 3 to 20, M represents an alkaline-earth metal atom, and x represents a numeral being about 1 to 5. Herein, the above formula is a schematic one.), or by the following general formula (B-7)

(B-7)

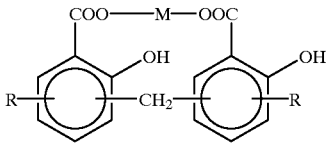

(R represents a chain hydrocarbon group having a carbon number of about 3 to 20, M represents an alkaline-earth metal atom, and x represents a numeral being about 1 to 5. Herein, the above formula is a schematic one.), are listed.

The alkaline-earth metal salts represented by the aforementioned general formulae (B-1) to (B-7) are generally called neutral salts. Basic or overbased alkaline-earth metal salts resulted from a basifying treatment with, for example, metallic oxides or metallic hydroxides, while blowing carbon dioxide into these neutral salts are preferably used. The overbased products are the one in which hydroxides or carbonates of the alkaline-earth metals are colloidally dispersed in these neutral salts, and usually, these are contained in the form of carbonate. Total base numbers (TBN) of these basic or overbased alkaline-earth metal salts are generally about 200 to 500 mgKOH/g.

Among these alkaline-earth metal salts of organic acids, neutral, basic, or overbased calcium salicylate or calcium sulfonate is the most preferable, and by the use of these, a lubricant composition exhibiting a further superior performance of preventing shudders from occurring when used as ATF or CVTF can be produced. A preferable blending amount of the (B) component is 0.1 to 10% by weight relative to an entirety of the lubricant composition.

The (A) component according to the present invention is likely to degrade due to oxidation to some extent, so that specific lubricant properties of the lubricant composition according to the present invention may not be maintained for a long time depending on usage conditions. Therefore, it is preferable to further contain an antioxidant as a (C) component. As the antioxidant, for example, a phenolic antioxidant, an amino antioxidant, a sulfur antioxidant, etc., are listed.

As the phenolic antioxidant, for example, 2,6-di-tert.-butylphenol (thereafter tert.-butyl is abbreviated to t-butyl.), 2,6-di-t-butyl-p-cresol, 2,6-di-t-butyl-4-methylphenol, 2,6-di-t-butyl-4-ethylphenol, 2,4-dimethyl-6-t-butylphenol, 4,4'-methylenebis(2,6-di-t-butylphenol), 4,4'-bis(2,6-di-t-butylphenol), 4,4'-bis(2-methyl-6-t-butylphenol), 2,2'-methylenebis(4-methyl-6-t-butylphenol), 2,2'-methylenebis (4-ethyl-6-t-butylphenol), 4,4'-butylidenebis(3-methyl-6-t-butylphenol), 4,4'-isopropylidenebis(2,6-di-t-butylphenol), 4,4'-butylidenebis(2,6-di-t-butylphenol), 2,2'-methylenebis (4-methyl-6-cyclohexylphenol), 2,2'-methylenebis(4-methyl-6-nonylphenol), 2,2'-isobutylidenebis(4,6-dimethylphenol), 2,6-bis(2'-hydroxy-3'-t-butyl-5'-methylbenzyl)-4-methylphenol, 3-t-butyl-4-hydroxyanisole, 2-t-butyl-4-hydroxyanisole, 3-(4-hydroxy-3,5-di-t-butylphenyl) propionic acid stearyl ester, 3-(4-hydroxy-3,5-di-t-butylphenyl) propionic acid oleyl ester, 3-(4-hydroxy-3,5-di-t-butylphenyl) propionic acid dodecyl ester, 3-(4-hydroxy-3,5-di-t-butylphenyl) propionic acid decyl ester, 3-(4-hydroxy-3,5-di-t-butylphenyl) propionic acid octyl ester, tetrakis{3-(4-hydroxy-3,5-di-t-butylphenyl) propionyloxymethyl} methane, 3-(4-hydroxy-3,5-di-t-butylphenyl) propionic acid glycerin monoester, ester of 3-(4-hydroxy-3,5-di-t-butylphenyl) propionic acid and glycerin monooleyl ether, 3-(4-hydroxy-3,5-di-t-butylphenyl) propionic acid butylene glycol ester, 3-(4-hydroxy-3,5-di-t-butylphenyl) propionic acid thiodiglycol ester, 4,4'-thiobis(3-methyl-6-t-butylphenol), 4,4'-thiobis(2-methyl-6-t-butylphenol), 2,2'-thiobis(4-methyl-6-t-butylphenol), 2,6-di-t-butyl-α-dimethylamino-p-cresol, 2,6-di-t-butyl-4-(N,N'-dimethylaminomethylphenol), bis(3,5-di-t-butyl-4-hydroxybenzyl)sulfide, tris{(3,5-di-t-butyl-4-hydroxyphenyl) propionyl-oxyethyl} isocianurate, tris(3,5-di-t-butyl-4-hydroxyphenyl) isocianurate, 1,3,5-tris(3,5-di-t-butyl-4-hydroxybenzyl) isocianurate, bis{2-metyl-4-(3-n-alkylthiopropionyloxy)-5-t-butylphenyl}sulfide, 1,3,5-tris (4-t-butyl-3-hydroxy-2,6-dimethylbenzyl) isocianurate, tetraphthaloyl-di(2,6-dimethyl-4-t-butyl-3-hydroxybenzyl sulfide), 6-(4-hydroxy-3,5-di-t-butylanilino)-2,4-bis (octylthio)-1,3,5-triazine, 2,2-thio-{diethyl-bis-3-(3,5-di-t-butyl-4-hydroxyphenyl)} proionate, N,N'-hexamethylenebis (3,5-di-t-butyl-4-hydroxy-hydrocinnamide), 3,5-di-t-butyl-4-hydroxy-benzyl-phosphoric acid diester, bis(3-methyl-4-hydroxy-5-t-butylbenzyl)sulfide, 3,9-bis[1,1-dimethyl-2-{β-(3-t-butyl-4-hydroxy-5-methylphenyl) propionyloxy}ethyl]-2,4,8,10-tetraoxaspiro[5,5]undecane, 1,1,3-tris(2-methyl-4-hydroxy-5-t-butylphenyl)butane, 1,3,5-trimethyl-2,4,6-tris(3,5-di-t-butyl-4-hydroxybenzyl) benzene, and bis{3,3'-bis-(4'-hydroxy-3'-t-butylphenyl) butylicacid} glycol ester, are listed.

As the amino antioxidant, for example, naphthylamine antioxidants, e.g., 1-naphthylamine, phenyl-1-naphthylamine, p-octylphenyl-1-naphthylamine, p-nonylphenyl-1-naphthylamine, p-dodecylphenyl-1-naphthylamine, and phenyl-2-naphthylamine; phenylenediamine antioxidants, e.g., N,N'-diisopropyl-p-phenylenediamine, N,N'-diisobutyl-p-phenylenediamine, N,N'-diphenyl-p-phenylenediamine, N,N'-di-β-naphthyl-p-phenylenediamine, N-phenyl-N'-isopropyl-p-phenylenediamine, N-cyclohexyl-N'-phenyl-p-phenylenediamine, N-1,3-dimethylbutyl-N'-phenyl-p-phenylenediamine, dioctyl-p-phenylenediamine, phenylhexyl-p-phenylenediamine, and phenyloctyl-p-phenylenediamine; diphenylamine antioxidants, e.g., dipyridylamine, diphenylamine, p,p'-di-n-butyldiphenylamine, p,p'-di-t-butyldiphenylamine, p,p'-di-t-pentyldiphenylamine, p,p'-dioctyldiphenylamine, p,p'-dinonyldiphenylamine, p,p'-didecyldiphenylamine, p,p'-didodecyldiphenylamine, p,p'-distyryldiphenylamine, p,p'-dimethoxydiphenylamine, 4,4'-bis(4-α,α-dimehylbenzoyl) diphenylamine, and p-isopropoxydiphenylamine; and phenothiazine antioxidants, e.g., phenothiazine, N-methylphenothiazine, N-ethylphenothiazine, 3,7-dioctylphenothiazine, phenothiazinecarboxylic acid ester, and phenoselenazine, are listed.

As the sulfur antioxidant, for example, dioctylthiodipropionate, didecylthiodipropionate, dilaurylthiodipropionate, dimyristylthiodipropionate, distearylthiodipropionate, laurylstearylthiodipropionate, distearyl-β,β'-thiodibutyrate, (3-octylthiopropionic acid) pentaerythritol tetraester, (3-decylthiopropionic acid) pentaerythritol tetraester, (3-laurylthiopropionic acid) pentaerythritol tetraester, (3-stearylthiopropionic acid) pentaerythritol tetraester, (3-oleylthiopropionic acid) pentaerythritol tetraester, 2-mercaptobenzimidazole, 2-mercaptomethylbenzimidazole, 2-benzimidazole disulfide, dilauryl sulfide, and amyl thioglycolate, are listed.

As metallic salt antioxidants, for example, nickel dithiocarbamate and zinc-2-mercaptobenzimidazole, are listed.

Among these antioxidants, the phenolic antioxidant or amino antioxidant is preferable.

A blending amount of the (C) component is preferably 0.01 to 10% by weight relative to an entirety of the lubricant composition, more preferably, is 0.02 to 3% by weight, and most preferably, is 0.03 to 1% by weight.

A lubricant base material usable for the present invention uses a base oil composed of a mineral oil, a synthetic oil, or a mixture thereof, a base grease in which a thickener is blended into such a base oil, and when it is used as an aqueous lubricating oil, water or the one in which an appropriate solvent is added to water, as a base material.

In the case in which the lubricant composition according to the present invention is used as a lubricating oil, a kinematic viscosity of the base oil is not specifically limited, but is preferably about 1 to 50 $mm^2/s$ at 100° C. and 10 to 1,000 $mm^2/s$ at 40° C., and a viscosity index (VI) is preferably 100 or more, more preferably, is 120 or more, and most preferably, is 135 or more.

The mineral oil usable as the base oil of the present invention is the separated one from a natural crude oil, and is produced by appropriate distillation, refinement, etc., thereof. Primary components of the mineral oil are hydrocarbons (most of these are paraffins, and in addition, naphthenes and aromatics are contained). Mineral oils produced by refining these using hydrotreating, solvent deasphalting, solvent extraction, solvent dewaxing, hydrogenation dewaxing, catalytic dewaxing, hydrocracking, alkali distillation, sulfuric acid treatment, clay treatment, etc., can also be preferably used.

The synthetic oil usable as the base oil of the present invention is a chemically synthesized lubricating oil, and, for example, poly-α-olefin, polyisobutylene (polybutene), diester, polyol ester, aromatic polycarboxylic acid ester, phosphate, silicate, polyalkylene glycol, polyphenyl ether, silicone, fluorinated compound, and alkylbenzene are listed. Among these, poly-α-olefin, polyisobutylene (polybutene), diester, polyol ester, polyalkylene glycol, etc., can be used for general purpose.

As the poly-α-olefin, the ones such as produced by origomerization or hydrogenation of, for example, 1-hexene, 1-octene, 1-nonene, 1-decene, 1-dodecene, and 1-tetradecene, are listed. As the diester, diesters of dibasic acids, for example, glutaric acid, adipic acid, azelaic acid, sebacic acid, and dodecanedioic acid, and alcohols, for example, 2-ethylhexanol, octanol, decanol, dodecanol, and tridecanol, etc., are listed. As the polyol ester, esters of polyols, for example, neopentylglycol, trimethylolethane, trimethylolpropane, glycerin, pentaerythritol, sorbitol, dipentaerythritol, and tripentaerythritol, or alkylene oxide adducts thereof, and aliphatic acids, for example, butyric acid, isobutyric acid, valeric acid, isovaleric acid, pivalic acid, capric acid, caproic acid, caprylic acid, lauric acid, myristic acid, palmitic acid, stearic acid, and oleic acid, etc., are listed. As the polyalkylene glycol, for example, polyethylene glycol, polypropylene glycol, polyethylene glycol monomethyl ether, and mono or dimethyl ether of block or random copolymer of ethylene oxide/propylene oxide.

In the case in which the lubricant composition according to the present invention is used as grease, a thickener is blended into the aforementioned base oil for a lubricating oil to produce base grease. As the thickener, for example, soap or complex soap thickener, telephthalamate thickener, urea thickener, organic non-soap thickeners such as polytetrafluoroethylene and fluorinated ethylene-propylene copolymer, and inorganic non-soap thickeners, are listed.

These thickeners may be used solely, or may be used in a combination of two or more kinds thereof. An amount of the thickener is not specifically limited, but, usually, is preferably about 3 to 40% by weight, more preferably, 5 to 20% by weight relative to the base grease composed of the base oil and the thickener. A consistency of the aforementioned base grease composed of the base oil and the thickener is not specifically limited, but, usually, is about 100 to 500.

The lubricant composition according to the present invention has a specific property exhibiting a low friction coefficient when a slip velocity is low and exhibiting increases in friction coefficient with increasing slip velocity. Therefore, the lubricant composition exhibits superior performance of preventing shudders from occurring when it is used as an ATF or a CVTF.

In the lubricant composition according to the present invention, another component, for example, an oiliness agent, an antifriction agent, an extreme pressure agent, a detergent, a dispersant, a viscosity index improver, an antifoamer, a corrosion inhibitor, a pour point depressant, an emulsifier, a surfactant, and a preservative, can be used together.

As the oiliness agent, for example, aliphatic acids, e.g., capric acid, caproic acid, pelargonic acid, caprylic acid, lauric acid, myristic acid, palmitic acid, stearic acid, oleic acid, linoleic acid, linolenic acid, arachic acid ($C_{20}$), gadoleic acid ($C_{20F1}$), behenic acid ($C_{22}$), erucic acid ($C_{22F1}$), lignoceric acid ($C_{24}$), selacholeic acid ($C_{24F1}$), cerotic acid ($C_{26}$), montanic acid ($C_{28}$), melissic acid ($C_{30}$), ceroplastic acid ($C_{35}$), ricinoleic acid, and 12-hydroxystearic acid; dicarboxylic acid, e.g., dimer acids, glutaric acid, adipic acid, pimeric acid, suberic acid, azelaic acid, sebacic acid, and dodecanedioic acid; alcohols, e.g., lauryl alcohol, myristyl alcohol, palmityl alcohol, stearyl alcohol, and oleyl alcohol; amides, e.g., laurylamide, myristylamide, palmitylamide, stearylamide, and oleylamide, or alkylene oxide adducts thereof; alkylamines, e.g., methylamine, dimethylamine, ethylamine, diethylamine, (iso) propylamine, di(iso)propylamine, butylamine, dibutylamine, hexylamine, dihexylamine, octylamine, dioctylamine, 2-ethylhexylamine, di(2-ethylhexyl)amine, decylamine, didecylamine, dodecylamine, didodecylamine, tridecylamine, ditridecylamine, cetylamine, dicetylamine, coconutalkylamine, di(coconutalkyl)amine, soybean oil-derived alkylamine, di(soybean oil-derived alkyl)amine, beef tallow-derived alkylamine, di(beef tallow-derived alkyl)amine, oleylamine, dioleylamine, stearylamine, and distearylamine; polyalkylenepolyamines, e.g., ethylenediamine, propylenediamine, diethylenetriamine, dipropylenetriamine, triethylenetetramine, tetraethylenepentamine, and pentaethylenehexamine; alkanolamines, e.g., monoethanolamine, N-methylmonoethanolamine, N,N'-dimethylmonoethanolamine, N-ethylmonoethanolamine, diethanolamine, N-methyldiethanolamine, N-ethyldiethanolamine, triethanolamine, monopropanolamine, dipropanolamine, tripropanolamine, 2-amino-2-methyl-1-propanol, 2-amino-2-methyl-1,3-propanediol, aminoethylethanolamine, N,N,N',N'-tetrakis (hydroxyethyl) ethylenediamine, and N,N,N',N'-tetrakis(2-hydroxypropyl) ethylenediamine, or alkylene oxide adducts thereof; and N-long-chain alkylalkanolamines, e.g., N-butylmonoethanolamine, N-hexylmonoethanolamine, N-octylmonoethanolamine, N-decylmonoethanolamine, N-coconutalkylmonoethanolamine, N-soybean oil-derived alkylmonoethanolamine, N-beef tallow-derived alkylmonoethanolamine, N-oleylmonoethanolamine, N-stearylmonoethanolamine, N-butyldiethanolamine, N-hexyldiethanolamine, N-octyldiethanolamine, N-decyldiethanolamine, N-coconutalkyldiethanolamine, N-soybean oil-derived alkyldiethanolamine, N-beef tallow-derived alkyldiethanolamine, N-oleyldiethanolamine, N-stearyldiethanolamine, N,N-dibutylmonoethanolamine, N,N-dihexylmonoethanolamine, N,N-dioctylmonoethanolamine, N,N-didecylmonoethanolamine, N,N-bis(coconutalkyl) monoethanolamine, N,N-bis (soybean oil-derived alkyl) monoethanolamine, N,N-bis (beef tallow-derived alkyl)monoethanolamine, N,N-dioleylmonoethanolamine, and N,N-distearylmonoethanolamine, or alkylene oxide adducts thereof, are listed. Alkanolamines or N-long-chain alkylalkanolamines may function as corrosion inhibitors or preservatives in some cases.

As the antifriction agent, for example, esters, e.g., capric acid (mono,di,tri)glyceride, caproic acid (mono,di,tri) glyceride, caprylic acid (mono,di,tri)glyceride, lauric acid (mono,di,tri)glyceride, myristic acid (mono,di,tri)glyceride, palmitic acid (mono,di,tri)glyceride, stearic acid (mono,di, tri)glyceride, oleic acid (mono,di,tri)glyceride, and polycondensate of ricinoleic acid or 12-hydroxystearic acid; and metallic salts, e.g., sulfurized oxymolybdenumdialkyldithiocarbamate, sulfurized oxymolybdenumdialkyldithiophosphate, zincdialkyldithiophosphate, and zincdialkyldithiocarbamate, are listed. Among these compounds, some have a performance of preventing oxidation.

As the extreme pressure agent, for example, sulfur compounds, e.g., sulfurized olefin, sulfurized paraffin, sulfurized polyolefin, sulfurized lard, sulfurized fish oil, sulfurized whale oil, sulfurized soybean oil, sulfurized pinene oil, sulfurized phenol, sulfurized alkylphenol, sulfurized aliphatic acid, dialkyl polysulfide, dibenzyl disulfide, diphenyl disulfide, polyphenylene sulfide, alkyl mercaptan, alkyl sulfonate, dithiocarbamate, 2,5-dimercapt-1,3,4-thiadiazole derivatives, thiuram disulfide, and dialkyldithiophosphoric acid dimer; and (thio,dithio)phosphoric acids or phosphorous acids, e.g., butyl(thio,dithio)phosphate or phosphite, hexyl(thio,dithio)phosphate or phosphite, octyl(thio,dithio) phosphate or phosphite, 2-ethylhexyl(thio,dithio)phosphate or phosphite, nonyl(thio,dithio)phosphate or phosphite, decyl(thio,dithio)phosphate or phosphite, lauryl(thio,dithio) phosphate or phosphite, myristyl(thio,dithio)phosphate or phosphite, palmityl(thio,dithio)phosphate or phosphite, stearyl(thio,dithio)phosphate or phosphite, oleyl(thio,dithio) phosphate or phosphite, phenyl(thio,dithio)phosphate or phosphite, and cresyl(thio,dithio)phosphate or phosphite, are listed. Among these compounds, some have a performance of preventing oxidation.

As the preservative, for example, calcium sulfonate, calcium phenate, calcium salicylate, magnesium sulfonate, magnesium phenate, magnesium salicylate, barium sulfonate, barium phenate, and barium salicylate, are listed. As the dispersing agent, for example, polyalkenylsuccinic acid monoimide or bisimide, phosphoric acid denatured polyalkenylsuccinic acid monoimide or bisimide, polyalkenylsuccinate, and benzylamine, are listed. As the viscosity index improver, for example, poly(meth)acrylate, polyisobutylene, polystylene, ethylene-propylene copolymer, and stylene isobutylene copolymer, are listed.

As the surfactant, for example, polyethyleneglycol, polyethyleneglycolmonoalkyl(aryl) ether, polyethyleneglycoldialkyl(aryl) ether, polyoxyethylene polyoxypropylene copolymer, polyol ester, polyether polyol, alkanolamide, alkylbenzenesulfonate, and petroleum sulfonate, are listed, and these surfactants may also function as oiliness agents or emulsifiers.

The lubricant compositions according to the present invention can be used for lubrication of every purpose. These can be used as various lubricating oils, for example, industrial lubricating oils, turbine oils, machine oils, bearing oils, compressor oils, hydraulic fluids, working fluids, internal combustion engine oils, refrigerator oils, gear oils, automatic transmission fluids (ATF), continuously variable transmission fluids (CVTF), transaxle fluids, and metal processing oils. These can be used as various greases for, for example, plain bearings, ball and roller bearings, gears, universal joints, torque limiters, automobile constant velocity joints (CVJ), ball joints, wheel bearings, constant velocity gears, and speed change gears.

The most preferable purpose of the lubricant compositions according to the present invention is the use as working fluids for wet clutches such as automatic transmission fluids (ATF) and continuously variable transmission fluids (CVTF).

EXAMPLES

The present invention will be more specifically explained below using the examples. In the following examples, part and % are on weight basis unless otherwise specified.

A refined paraffinic mineral oil (kinematic viscosity at 100° C.: 4.2 $mm^2/s$) is used as a base oil, and lubricant compositions of the present invention and of comparable samples having compositions as shown in the following Tables 1 to 3 are prepared. On these lubricant compositions, evaluation tests for performance of preventing shudders were made in the following manner. In Examples 5, and 12 to 14 and Comparative examples 5 and 6, evaluation tests of performance of preventing shudders were also made on lubricant compositions after being degraded by oxidation under the following conditions.

Evaluation test for performance of preventing shudders:

In conformity with the testing method for automatic transmission fluid (JASO-M349-95), using the following each lubricant composition of the present invention and of comparative samples, by a low velocity friction apparatus (LVFA), friction coefficients at low velocity slip ($\mu_1$) and high velocity slip ($\mu_{50}$) are measured at an oil temperature of 40° C. under a surface pressure of 1.00±0.05 MPa. Herein, $\mu_1$ is a friction coefficient at a slip velocity of 0.006 m/s, and $\mu_{50}$ is a friction coefficient at a slip velocity of 0.030 m/s.

Method for degradation of lubricant composition:

In conformity with the testing method for oxidation stability of lubricating oil (JIS K-2514), 250 ml of lubricant composition sample was put into a tube containing a copper plate and an iron plate as catalysts, and this was agitated involving air at a temperature of 165.5° C. with the number of revolutions of 1300 rpm for 24 hours so as to be forced to degrade by oxidation.

The results of these measurements of friction coefficients and ratios of both friction coefficients ($\mu_1/\mu_{50}$) are shown in Table 1 to 3.

TABLE 1

| Present Invention | 1 | 2 | 3 | 4 | 5 | 6 | 7 |
|---|---|---|---|---|---|---|---|
| (A) | | | | | | | |
| behenyl glceryl ether | 1.0 | | | | | | |
| oleyl glyceryl ether | | 1.0 | | | | | |
| lauryl glyceryl ether | | | 1.0 | | | | |
| octyl glyceryl ether | | | | 1.0 | | | |
| oleyl glyceryl ether A*1 | | | | | 1.0 | | |
| oleyl glyceryl ether | | | | | | 1.0 | |
| 2-hexyldodecyl glycer-yl ether | | | | | | | 1.0 |
| (B) | | | | | | | |
| calcium sulphonate | 1.0 | 1.0 | 1.0 | 1.0 | 1.0 | 1.0 | 1.0 |
| (C) | | | | | | | |
| 4,4'butylidenebis (2,6-di-t-butyl phenol) | 0.5 | 0.5 | 0.5 | 0.5 | 0.5 | 0.5 | 0.5 |
| Polymethacrylate (MW = 50,000) | 10 | 10 | 10 | 10 | 10 | 10 | 10 |
| Di(octyl)dithio zincphosphate | 1.5 | 1.5 | 1.5 | 1.5 | 1.5 | 1.5 | 1.5 |
| Another additive*2 | 1.0 | 1.0 | 1.0 | 1.0 | 1.0 | 1.0 | 1.0 |
| Base oil | rest | rest | rest | rest | rest | rest | rest |
| Friction coefficient of $\mu_1$ | 0.132 | 0.127 | 0.129 | 0.130 | 0.128 | 0.131 | 0.127 |
| Friction coefficient of $\mu_{50}$ | 0.149 | 0.151 | 0.148 | 0.149 | 0.150 | 0.152 | 0.151 |
| Ratio of $\mu(\mu_1/\mu_{50})$ | 0.89 | 0.84 | 0.87 | 0.87 | 0.85 | 0.87 | 0.84 |
| Friction coefficient of $\mu_1$ after degradation | | | | | 0.127 | | |
| Friction coefficient of $\mu_{50}$ after degradation | | | | | 0.146 | | |
| Ratio of $\mu(\mu_1/\mu_{50})$ after degradation | | | | | 0.87 | | |

TABLE 2

| Present Invention | 8 | 9 | 10 | 11 | 12 | 13 | 14 |
|---|---|---|---|---|---|---|---|
| (A) | | | | | | | |
| oleyl glyceryl ether | 1.0 | 1.0 | 1.0 | 1.0 | | | |
| oleyl polyglyceryl ether A*1 | | | | | 1.0 | 1.0 | 1.0 |
| (B) | | | | | | | |
| Calcium phenate | 1.0 | | | | 1.0 | 1.0 | 1/0 |
| calcium salicylate | | 1.0 | | | | | |
| magnesium salicylate | | | 1.0 | | | | |
| barium sulphonate | | | | 1.0 | | | 1.0 |
| (C) | | | | | | | |
| phenyl-1-naphthyl amine | 0.5 | 0.5 | 0.5 | 0.5 | 0.5 | | |
| dioctyl thiopropionate | | | | | | 0.5 | |
| Polymethacrylate (MW = 50,000) | 10 | 10 | 10 | 10 | 10 | 10 | 10 |
| Di(octyl)dithio zincphosphate | 1.5 | 1.5 | 1.5 | 1.5 | 1.5 | 1.5 | 1.5 |
| Another additive*2 | 1.0 | 1.0 | 1.0 | 1.0 | 1.0 | 1.0 | 1.0 |
| Base oil | rest | rest | rest | rest | rest | rest | rest |
| Friction coefficient of $\mu_1$ | 0.128 | 0.127 | 0.129 | 0.127 | 0.127 | 0.127 | 0.127 |
| Friction coefficient of $\mu_{50}$ | 0.149 | 0.148 | 0.149 | 0.148 | 0.149 | 0.149 | 0.149 |
| Ratio of $\mu(\mu_2/\mu_{50})$ | 0.86 | 0.86 | 0.87 | 0.86 | 0.85 | 0.85 | 0.85 |
| Friction coefficient of $\mu_1$ after degradation | | | | | 0.127 | 0.129 | 0.133 |
| Friction coefficient of $\mu_{50}$ after degradation | | | | | 0.148 | 0.145 | 0.143 |
| Ratio of $\mu(\mu_1/\mu_{50})$ after degradation | | | | | 0.86 | 0.89 | 0.93 |

TABLE 3

| Comparative sample | 1 | 2 | 3 | 4 | 5 | 6 |
|---|---|---|---|---|---|---|
| Oleyl glyceryl ether | | | | 1.0 | | |
| Oleyl polyglyceryl ether A*1 | | | | | | 1.0 |
| Oleic acid monoglyceride | | 1.0 | | | | |
| Isostearic acid tri-ethylenepentamine condensate | | | 1.0 | | | |
| Calcium sulfonate | | | | | 1.0 | |
| 4,4'butylidenebis (2,6-di-t-butyl phenol) | 0.5 | 0.5 | 0.5 | 0.5 | 0.5 | 0.5 |
| Polymethacrylate (MW = 50,000) | 10 | 10 | 10 | 10 | 10 | 10 |
| Di(octyl)dithio zincphosphate | 1.5 | 1.5 | 1.5 | 1.5 | 1.5 | 1.5 |
| Another additive*2 | 1.0 | 1.0 | 1.0 | 1.0 | 1.0 | 1.0 |
| Base oil | rest | rest | rest | rest | rest | rest |
| Friction coefficient of $\mu_1$ | 0.148 | 0.132 | 0.133 | 0.130 | 0.150 | 0.131 |
| Friction coefficient of $\mu_{50}$ | 0.132 | 0.140 | 0.141 | 0.135 | 0.151 | 0.136 |
| Ratio of $\mu(\mu_1/\mu_{50})$ | 1.12 | 0.94 | 0.94 | 0.96 | 0.99 | 0.96 |
| Friction coefficient of $\mu_1$ after degradation | | | | | 0.158 | 0.142 |
| Friction coefficient of $\mu_{50}$ after degradation | | | | | 0.156 | 0.145 |
| Ratio of $\mu(\mu_1/\mu_{50})$ after degradation | | | | | 0.99 | 0.98 |

*1: a mixture of oleyl alcohol 20%, oleylglyceryl ether 30%, and oleylpolyglyceryl ether (average degree of polymerization 3) 50% (average degree of polymerization is 2.1 as a mixture of oleylglyceryl ether and oleylpolyglyceryl ether)
*2: antifoamer, etc.

Since the lubricant compositions of the present invention 1 to 14 have $\mu_1/\mu_{50}$ values of 0.84 to 0.87, they exhibit excellent performance of preventing shudders. On the other hand, the lubricant compositions of the Comparative sample 1 has $\mu_1/\mu_{50}$ values greater than 1, so that the performance of preventing shudders from occurring is inferior to those of the present invention. The lubricant compositions of the Comparative samples 2 and 3 decrease friction coefficients at a low velocity ($\mu_1$), these decrease, however, friction coefficients at a high velocity ($\mu_{50}$) at the same time, so that the ratio of $\mu$ is 0.94, and therefore, the performance of preventing shudders from occurring is not said to be good. From the results on the Comparative samples 4 and 5, it is understood that when the (B) component of the present invention is not included, friction coefficients at a high velocity ($\mu_{50}$) do not increase, and when the (A) component is not included, friction coefficients at a low velocity ($\mu_1$) do not decrease.

The lubricant compositions of the present invention 5, 12, and 13 containing the (C) component have $\mu_1/\mu_{50}$ values of 0.86 to 0.89 after degradation by oxidation, and therefore, it can be said that these have performances of sufficiently preventing shudders from occurring compared to the lubricant compositions of the Comparative samples 5 and 6 and $\mu_1/\mu_{50}$ thereof after degradation by oxidation. The lubricant composition of the present invention 14 not containing the (C) component has $\mu_1/\mu_{50}$ of 0.93 after degradation by oxidation, and therefore, a little degradation in performance can be seen. This shows that in the case in which the lubricant composition of the present invention is used in severe conditions or for a long time, it is preferable to use the (C) component (antioxidant).

An advantage of the present invention is to provide a lubricant composition having a specific property exhibiting increases in friction coefficient with increasing slip velocity by using a (poly)glyceryl ether and an alkaline-earth metal salt of an organic acid together.

What is claimed is:

1. A lubricant composition for a transmission fluid wherein the transmission fluid is an automatic transmission fluid, a continuously variable transmission fluid, or a working fluid for a wet clutch, comprising a lubricant base oil containing: a glyceryl ether or a polyglyceryl ether represented by the following general formula (1)

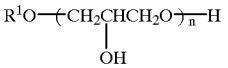

(1)

wherein $R^1$ represents a hydrocarbon group and n represents a numeral being 1 or more, as a component (A); and an alkaline-earth metal salt of an organic acid as a component (B).

2. A lubricant composition according to claim 1, further comprising an antioxidant as a (C) component.

3. A lubricant composition according to claim 1, wherein said organic acid is sulfonic acid, phenol, or salicylic acid.

4. A lubricant composition according to claim 1, wherein said $R^1$ is an alkyl group or an alkenyl group having a carbon number of 4 to 30.

5. A lubricant composition according to claim 1, wherein said n is a numeral being 1.2 or more.

6. A transmission fluid, comprising a lubricant composition as claimed in any one of claims 1 to 5.

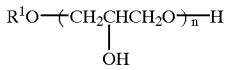

(1)

7. The transmission fluid according to claim 6, wherein the transmission fluid is an automatic transmission fluid or a continuously variable transmission fluid.

8. The transmission fluid according to claim 6, wherein the transmission fluid is a working fluid for a wet clutch.

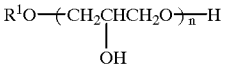

(1)

9. A lubricant composition according to claim 1, wherein the transmission fluid is an automatic transmission fluid or a continuously variable transmission fluid.

10. A lubricant composition according to claim 1, wherein the transmission fluid is a working fluid for a wet clutch.

* * * * *